US007387001B2

(12) United States Patent
Wakata et al.

(10) Patent No.: US 7,387,001 B2
(45) Date of Patent: Jun. 17, 2008

(54) FASTENER TAPE AND FASTENER STRINGER

(75) Inventors: Syuji Wakata, Toyama-ken (JP); Yuji Kondo, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/717,315

(22) Filed: Mar. 13, 2007

(65) Prior Publication Data

US 2007/0227198 A1 Oct. 4, 2007

(30) Foreign Application Priority Data

Mar. 31, 2006 (JP) ..... 2006-099369

(51) Int. Cl.
*D04B 21/00* (2006.01)

(52) U.S. Cl. ..... 66/195; 66/193

(58) Field of Classification Search ..... 66/195, 66/193, 190, 191, 192; 24/391–393
See application file for complete search history.

(56) References Cited

U.S. PATENT DOCUMENTS

| | | | | |
|---|---|---|---|---|
| 4,279,134 | A | 7/1981 | Matsuda | |
| 5,615,563 | A * | 4/1997 | Matsuda et al. | 66/193 |
| 5,706,677 | A * | 1/1998 | Matsuda | 66/192 |
| 5,802,883 | A * | 9/1998 | Matsuda et al. | 66/193 |
| 5,857,359 | A | 1/1999 | Matsuda et al. | |
| 6,006,552 | A * | 12/1999 | Matsuda et al. | 66/193 |
| 6,148,643 | A * | 11/2000 | Matsuda et al. | 66/193 |
| 6,766,669 | B1 | 7/2004 | Tung | |
| 6,886,368 | B2 * | 5/2005 | Matsuda | 66/192 |
| 6,971,253 | B2 * | 12/2005 | Matsuda et al. | 66/193 |
| 7,152,438 | B2 * | 12/2006 | Matsuda | 66/192 |
| 2004/0231368 | A1 * | 11/2004 | Matsuda | 66/195 |
| 2006/0213235 | A1 * | 9/2006 | Matsuda | 66/192 |

FOREIGN PATENT DOCUMENTS

| | | |
|---|---|---|
| AU | 15587/66 | 7/1968 |
| EP | 0 727 159 | 8/1996 |
| EP | 1 449 451 | 8/2004 |
| JP | 55-10918 | 1/1980 |
| JP | 3396335 | 2/2003 |
| JP | 3439574 | 6/2003 |
| JP | 2005-230040 | 9/2005 |

* cited by examiner

*Primary Examiner*—Danny Worrell
(74) *Attorney, Agent, or Firm*—Alston & Bird LLP

(57) ABSTRACT

The invention provides a fastener tape for a slide fastener, which prevents stretching of an element attaching portion in a tape longitudinal direction while maintaining plasticity possessed by a knitted fabric inherently and has the improved strength of the element attaching portion, wherein a narrow width fastener tape is composed of a warp knitting structure in which an element attaching portion constituted of a plurality of wales is formed by knitting along one side edge of a tape main body portion, the element attaching portion is formed by disposing at least: a warp knitting yarn which runs in a zigzag fashion forming a needle loop across two or more wales adjacent to each other such that the needle loop is entangled with a needle loop of another knitting yarn of every other course on a wale; and a weft in-laid yarn which runs across two or more wales adjacent to each other.

13 Claims, 7 Drawing Sheets

4-3/0-1

FASTENER TAPE AND FASTENER STRINGER

BACKGROUND OF THE INVENTION

1. Field of the Invention

The present invention relates to a narrow width fastener tape for slide fastener composed of a warp knitting structure, and a fastener stringer in which a continuous fastener element row is attached to the fastener tape. More particularly, the invention relates to a narrow width fastener tape and a fastener stringer which have plasticity inherently possessed by a knitted fabric while its element attaching portion is difficult to stretch in a longitudinal direction and strength of the element attaching portion is intensified.

2. Description of the Related Art

In recent years, a slide fastener has been adopted by a variety of soft clothes, and thus, the plasticity of a fastener tape itself has been demanded. Then, a fastener tape composed of a warp knitting structure has been widely used from a point of view that it is more plastic than a woven fabric or the like and has an excellent stability in configuration. In general, a fastener tape of a warp knitting structure for use in a slide fastener comprises a tape main body portion to be sewed to an attachment object such as clothes and an element attaching portion to be formed along one side edge of the tape main body portion. A continuous fastener element row formed in a shape of a coil is attached to the element attaching portion by sewing.

An example of such fastener tapes for slide fastener has been described in Japanese Patent Application Laid-Open No. 55-10918, Japanese Patent No. 3439574 and the like. For example, the slide fastener tape described in the Japanese Patent Application Laid-Open No. 55-10918 has an element attaching portion (denoted as a teeth attachment area in the same document) along one side edge of a tape main body portion (denoted as an intermediate area in the same document) while an ear portion (denoted as a side edge area in the same document) is possessed on a side edge on an opposite side to the element attaching portion.

In the Japanese Patent Application Laid-Open No. 55-10918, a foundation structure of the tape main body portion is constituted of a single cord knitting yarn running across four wales and a tricot knitting yarn. A textured yarn is used as the single cord knitting yarn, and a multi-filament yarn is used as the tricot knitting yarn. Further, a chain knitting yarn composed of a multi-filament yarn is entangled in the foundation structure of the tape main body portion in the element attaching portion and the ear portion while a warp in-laid yarn composed of a multi-filament yarn is inserted in each wale in a zigzag fashion.

On the other hand, the Japanese Patent No. 3439574 discloses an invention about a fastener tape for slide fastener, in which an element attaching portion is blocked from being stretched or contracted in a longitudinal direction and a tape main body portion has a function capable of being stretched or contracted in the longitudinal direction. In a fastener tape described as an example of embodiments in the Japanese Patent No. 3439574, a foundation structure of the tape main body portion is constituted of a tricot knitting yarn composed of a multi-filament yarn and a single cord knitting yarn disposed across four wales and composed of a textured yarn. In an element attaching portion formed on one side edge of the tape main body portion, a chain knitting yarn composed of a multi-filament yarn and a warp in-laid yarn composed of a multi-filament yarn are disposed in the foundation structure of the tape main body portion.

In a fastener tape described as another embodiment in the Japanese Patent No. 3439574, a two needle stitch knitting yarn composed of a multi-filament yarn is disposed over all wales, a single cord knitting yarn composed of a textured yarn is disposed across four wales in the tape main body portion, a chain knitting yarn composed of a multi-filament yarn is disposed in the element attaching portion, and a weft in-laid yarn composed of a textured yarn is disposed across four wales with respect to the wales which constitute an element attaching portion and the tape main body portion on a side of the element attaching portion.

Further, in a wale formed on an outermost side of the element attaching portion in the above-described two kinds of fastener tapes described in the Japanese Patent No. 3439574, a chain knitting yarn thicker than chain knitting yarns disposed in other wales of the element attaching portion is disposed. Also as a knitting yarn disposed on an outermost side edge of the tape main body portion on the opposite side, a thicker knitting yarn than other knitting yarns disposed in the tape main body portion is used.

Thus, in the fastener tape of the Japanese Patent No. 3439574, an edge portion of the element attaching portion is reinforced by the thick knitting yarn, so that the fastener elements can be attached stably. Further, because the tape main body portion is composed of a knitting structure capable of being stretched or contracted, sewing means suitable for an attachment object may be used. Additionally, because the edge portion of the tape main body portion is reinforced by entangling of two kinds of thick knitting yarns, the fastener tape is prevented from being damaged and the fastener tape can be sewed to the attachment object beautifully.

On the other hand, as well as a slide fastener in which a continuous fastener element row is attached to the above-described fastener tape by sewing, there has been known a knit-in slide fastener configured such that a fastener tape is knitted using a double warp knitting machine having two columns of needle beds, and at a same time, a continuous fastener element row is attached to its element attaching portion by knitting therein. An example of the knit-in slide fastener has been described in, for example, Japanese Patent No. 3396335, Japanese Patent Application Laid-Open No. 2005-230040 and the like.

In the slide fastener described in the Japanese Patent No. 3396335, a tape main body portion is constituted of a chain knitting yarn, a tricot knitting yarn and a weft in-laid yarn to be inserted across four wales. Further, in the element attaching portion, a fixing chain knitting yarn constituted of a compact double chain knitting structure knits and fixes a fastener element row into a foundation structure constituted of a tricot knitting yarn, a weft in-laid yarn and a chain knitting yarn disposed on the outermost side of an element attaching portion.

Specifically, in the Japanese Patent No. 3396335, among a plurality of fixing chain knitting yarns, a size of the fixing chain knitting yarn near a coupling head of the fastener element is set larger than a size of the remaining fixing knitting yarns. At the same time, a needle loop of the fixing chain knitting yarn presses a tope face of an upper leg portion of an element while upper and lower leg portions of the element are tightened firmly by its sinker loop. Consequently, a tightening force and a contact area of the thickest fixing chain knitting yarn to the element are increased, so that the elements are attached strongly to the fastener tape. Further, according to the Japanese Patent No. 3396335, an attachment state of the upper and lower leg portions of the element is more stabilized, so that even when a strong bending force or push-up force is applied to a fastener surface of the slide fastener, engagement of fastener element rows can be prevented from being released.

However, when the fastener tape is knitted using the double warp knitting machine as described in the Japanese Patent No. 3396335, a stitch is formed with one needle by entangling a chain knitting yarn of a double structure, a chain knitting yarn of a single structure, a tricot knitting yarn and the like. Thus, a load applied to the needle is remarkably increased when the continuous fastener element row is fixed with a fixing knitting yarn. For this reason, breaking of the needle or skip stitch of each knitting yarn frequently occurs, which makes it very difficult to knit a fastener tape rapidly. If the leg portion on a side of a head of the element is fixed firmly with the double chain knitting yarn for fixing the element like the knit-in slide fastener described in the Japanese Patent No. 3396335, motion of the element at a time of opening/closing decreases although an engaging strength is intensified by reinforcement of the knitting yarn. Consequently, a sliding operation of a slider becomes heavy, which is an inconvenient matter to be solved.

To solve such a problem, in the knit-in slide fastener described in the Japanese Patent Application Laid-Open No. 2005-230040, basically, an element attaching portion is constituted of a foundation chain knitting yarn composed of a single structure and three or more fixing knitting yarns composed of a double structure. The fixing chain knitting yarn of the double structure constitutes a foundation structure in which a continuous fastener element row is placed such that one needle loop strides and presses over a leg portion of the continuous fastener element row while the other needle loop is entangled with a needle loop of the foundation knitting yarn.

In the knit-in slide fastener described in the Japanese Patent Application Laid-Open No. 2005-230040, both the double structure and single structure are constituted of the chain knitting structure, and further, two or more knitting yarns are not entangled in each needle. Thus, no overload is applied to the needle when the fastener tape is knitted, thereby preventing occurrence of breaking or stitch skip. Further, because according to the Japanese Patent Application Laid-Open No. 2005-230040, the double knitting yarn and single knitting yarn are knitted with the same chain knitting structure, no excessive motion is required in a knitting machine, thereby achieving a high-speed operation.

Further, because the foundation structure of the element attaching portion is constituted of the fixing chain knitting yarn and the foundation chain knitting yarn, stretching of the fastener tape in a longitudinal direction is suppressed to an appropriate extent in the element attaching portion. Additionally, because the needle loop of the fixing chain knitting yarn is disposed on both upper and lower faces of the fastener element and the fastener element is sandwiched by the sinker loop, the fastener element is tightened and fixed. Thus, the attachment strength of the fastener element row is high and a surface portion of the fastener element is soft, so that the sliding performance of the slider is improved.

In recent years, an application of the slide fastener has been expanded in diversified fields such as clothes and bags. For this reason, the slide fastener has been demanded to have a feature and function corresponding to such an application, and its fastener tape also has been demanded to possess diversified features and texture.

However, in the conventional fastener tapes, a knitted space of a knitting machine for knitting a narrow width tape is very small, and a warp knitting structure of the fastener tape is limited to a particular kind for a reason of a needle strength, so that a new feature and superiority cannot be applied to the fastener tape itself easily. For example, assuming that any knitting yarn which runs in a zigzag fashion forming the needle loop is disposed across two or more wales of the tricot knitting yarn or single cord knitting yarn at the element attaching portion of the fastener tape together with the chain knitting yarn as described in the Japanese Patent Application Laid-Open No. 55-10918 and Japanese Patent No. 3439574, the weft in-laid yarn cannot be inserted easily into the element attaching portion, so that the strength of the element attaching portion cannot be increased more than some extent.

In general, as for the slide fastener, the strength demanded for the fastener tape is increased as a size of the fastener element is increased. Therefore, because the fastener tape including no weft in-laid yarn at the element attaching portion has a limit in its strength, the size of the fastener element which can be attached is limited, which is a weak point to be solved. For this reason, the conventional fastener tapes having the single structure have not been used as a fastener tape for a slide fastener whose chain width is 7 mm or more.

If the knitting structure of the element attaching portion is constituted of the chain knitting yarn and the two needle stitch knitting yarn like the fastener tape described in the Japanese Patent No. 3439574 as another embodiment, the weft in-laid yarn can be inserted into the element attaching portion. However, in this case, nothing but a sinker loop parallel in a wale direction is formed in the chain knitting yarn and nothing but a sinker loop parallel in the wale direction and a course direction is formed in the two needle stitch knitting yarn. As a result, the element attaching portion has no sinker loop running obliquely across two or more wales between respective courses adjacent to each other like, for example, the tricot knitting yarn and single cord knitting yarn.

Thus, in a case of the fastener element as described in the Japanese Patent Application Laid-Open No. 55-10918 in which, for example, the tricot knitting yarn and the single cord knitting yarn are disposed in the element attaching portion, a lateral pulling force is applied when the slide fastener is in an engagement, for example, the element attaching portion is stretched in the width direction, and at the same time, the element attaching portion is contracted in a longitudinal direction by the sinker loops of the tricot knitting yarn or the single cord knitting yarn which run obliquely. As a consequence, an interval between respective elements of the fastener element row is narrowed, so that the engagement strength between right and left element rows is intensified. Accordingly, even when a lateral pulling force is applied to the fastener tape, the engagement of the fastener tapes can be prevented from being released.

However, if the element attaching portion is formed of the chain knitting yarn, the two needle stitch knitting yarn and the weft in-laid yarn as described in the Japanese Patent No. 3439574 as another embodiment, the element attaching portion has no sinker loop running obliquely across two or more wales between respective courses adjacent to each other like the single cord knitting yarn or the like. Thus, even if a lateral pulling force is applied to the fastener tape, the element attaching portion is not contracted in the longitudinal direction. For this reason, the engagement strength of the right and left element rows cannot be increased, and consequently, the engagement is sometimes released when the lateral pulling force is received.

On the other hand, if the element attaching portion is constituted of the double knitting structure as described in the Japanese Patent No. 3396335 and Japanese Patent Application Laid-Open No. 2005-230040, there is a problem that the plasticity inherently possessed by the knitted fabric is lost because the thickness of the element attaching portion is increased. For this reason, some measures such as forming the knitting yarn fine so as to decrease the thickness of the tape has been adopted conventionally in order to provide the fastener tape with plasticity.

In this case, however, there is such an inconvenience that the strength of the element attaching portion may drop although the plasticity of the slide fastener is secured. Strength of a material can be intensified, for example, by using a high-multi yarn as the knitting yarn at the element attaching portion in order to prevent the strength of the element attaching portion from dropping. In contrast, there exists such a problem that material cost is increased.

SUMMARY OF THE INVENTION

Accordingly, the present invention has been achieved in views of the above-described conventional problems, and an object of the invention is to provide a fastener tape for slide fastener and a fastener stringer capable of suppressing a stretching of the fastener tape in the longitudinal direction at an element attaching portion while maintaining the plasticity inherently possessed by the knitted fabric so as to improve the strength of the element attaching portion and preventing the engagement of fastener elements from being released when the fastener tape is used in the slide fastener.

To achieve the above-described object, according to an aspect of the present invention, there is provided a narrow width fastener tape for a slide fastener, composed of a warp knitting structure in which an element attaching portion constituted of a plurality of wales is integrally formed by knitting along one side edge of a tape main body portion, wherein the element attaching portion is formed by disposing at least: a warp knitting yarn which runs in a zigzag fashion forming a needle loop across two or more wales adjacent to each other such that the needle loop is entangled with a needle loop of another knitting yarn of every other course on a wale; and a weft in-laid yarn which runs across two or more wales adjacent to each other.

Preferably, the element attaching portion is constituted of a knitting structure formed of a tricot knitting yarn, a chain knitting yarn, and a single cord knitting yarn.

Preferably, a sinker loop of the single cord knitting yarn and the weft in-laid yarn cross each other between respective courses of the element attaching portion, and the single cord knitting yarn and the weft in-laid yarn are disposed alternately in a first wale formed on an outer most side of the element attaching portion. In this case, preferably, the weft in-laid yarn is inserted across wales which are fewer at least by one than a number of wales over which the single cord knitting yarn runs.

In the invention, it is preferable that a warp in-laid yarn is inserted into the element attaching portion.

Preferably, the element attaching portion is constituted of a knitting structure formed of a tricot knitting yarn, a tricot type two needle stitch knitting yarn, and a chain knitting yarn disposed in part of wales.

Preferably, a sinker loop of the tricot type two-stitch knitting yarn and the weft in-laid yarn cross each other between respective courses of the element attaching portion, and the tricot type two needle stitch knitting yarn and the weft in-laid yarn are disposed alternately in a first wale formed on the outermost side of the element attaching portion. Further in this case, preferably, the weft in-laid yarn is inserted across wales which are fewer at least by one than a number of wales over which the tricot type two needle stitch knitting yarn runs.

In the invention, it is preferable that a warp in-laid yarn is further inserted into the element attaching portion.

Preferably, the warp knitting yarn and the weft in-laid yarn are disposed alternately in a first wale formed on an outermost side of the element attaching portion.

Preferably, the weft in-laid yarn is inserted across wales which are fewer at least by one than a number of wales over which the warp knitting yarn runs. And further preferably, the warp in-laid yarn is inserted into the element attaching portion.

According to another aspect of the invention, there is provided a fastener stringer, wherein a fastener element row is attached to the element attaching portion of the fastener tape having the above-described structure.

In the narrow width fastener tape for a slide fastener of the present invention, the element attaching portion is formed by disposing at least: a warp knitting yarn which runs in a zigzag fashion forming a needle loop across two or more wales adjacent to each other such that the needle loop is entangled with a needle loop of another knitting yarn of every other course on a wale; and a weft in-laid yarn which runs across two or more wales adjacent to each other.

In the conventional warp knitting machine for knitting a narrow width fastener tape, the fastener tape warp knitting structure is limited to a particular kind as described above because of a small knitted space and a problem of a needle strength. However, as a result of accumulated research about a structure of the warp knitting machine and the like, inventors of the present invention have succeeded in developing a new crochet knitting machine capable of knitting a narrow width fastener tape by increasing the numbers of the knitting yarns and the in-laid yarns to be entangled with each stitch as compared with conventional examples even within a small knitted space. Then, they have found that a fastener tape produced by knitting a fastener tape using this new crochet knitting machine has an excellent quality never obtained conventionally and have completed the present invention.

The fastener tape of the present invention is constituted of at least the warp knitting yarn which runs in a zigzag fashion forming a needle loop across two or more wales adjacent to each other like the tricot knitting yarn, the single cord knitting yarn and the tricot type two needle stitch knitting yarn such that the needle loop is entangled with a needle loop of another knitting yarn of every other course on a wale and the weft in-laid yarn running across two or more wales adjacent to each other. In the fastener tape, existence of the warp knitting yarn suppresses stretching of the element attaching portion in the longitudinal direction to prevent an interval between respective elements from being increased, thereby stabilizing an element pitch. The tricot type two needle stitch knitting yarn mentioned in the present invention refers to a knitting yarn which is disposed in the zigzag fashion forming a needle loop across two wales adjacent to each other of each course, to form, for example, a knitting structure of 2-4/2-0. (Please see FIG. 9.)

Because the strength of the element attaching portion is improved due to existence of the weft in-laid yarn, the yarns are unlikely to be loose and the fastener tape can be used in a slide fastener having a chain width of 7 mm or more, so that an application thereof can be expanded. Further, the fastener tape of the present invention has sufficient plasticity inherently possessed by a knitted fabric because a thickness of the element attaching portion is not as large as a double knitting structure.

In the fastener tape of the present invention, its element attaching portion is constituted of the knitting structure formed of the tricot knitting yarn, the chain knitting yarn and the single cord knitting yarn. Such a fastener tape can suppress stretching of the element attaching portion in the longitudinal direction effectively so as to sew fastener elements stably and prevent the interval between respective elements from being enlarged.

In the fastener tape of the present invention, the sinker loop of the single cord knitting yarn and the weft in-laid yarn are entangled between respective courses of the element attaching portion, and the single cord knitting yarn and the weft in-laid yarn are disposed alternately in the first wale formed on the outermost side of the element attaching portion. Consequently, the existence of the weft in-laid yarn intensifies yarn density at a portion in which no single cord knitting yarn is disposed, so that the strength of the element attaching portion can be further improved. Accordingly, even if a strong pulling force is applied to the obtained fastener tape after a continuous fastener element row is sewed on the fastener tape, the fastener tape can be prevented from being torn at a portion of the element attaching portion in which a sewing yarn for the fastener element row has been thrust.

In this case, according to the present invention, the weft in-laid yarn is inserted across wales which are fewer by at least one than the number of wales over which the single cord knitting yarn runs. Consequently, when a lateral pulling force is applied when the slide fastener is in an engaged state, the element attaching portion is deflected to be contracted in the longitudinal direction of the fastener tape without the single cord knitting yarn's being captured by the weft in-laid yarn. As a result, the interval between the fastener elements of the fastener element row is narrowed to thereby intensify the engagement strength of right and left fastener element rows, and consequently, the engagement of the fastener elements can be prevented from being released even if the lateral pulling force is applied to the tape.

Moreover, in the fastener tape, the warp in-laid yarn can be inserted into the element attaching portion, so that the element attaching portion can be further prevented from being stretched in the longitudinal direction and the strength of the element attaching portion can be improved.

Next, in the fastener tape of another aspect of the present invention, the element attaching portion is constituted of the knitting structure formed of the tricot knitting yarn, the tricot type two needle stitch knitting yarn, and the chain knitting yarn disposed in part of the wale. Such a fastener tape can suppress stretching of the element attaching portion in the longitudinal direction effectively, so that, for example, a sewing operation of the fastener elements can be carried out stably and the interval between respective elements can be blocked from being enlarged.

The sinker loop and the weft in-laid yarn of the tricot type two needle stitch knitting yarn are entangled with each other between respective courses of the element attaching portion, and further, the tricot type two needle stitch knitting yarn and the weft in-laid yarn are disposed alternately in a first wale formed on the outermost side of the element attaching portion. Consequently, the existence of the weft in-laid yarn intensifies the yarn density at a portion in which no tricot type two-stitch yarn is disposed, thereby improving the strength of the element attaching portion. Therefore, even if a strong lateral pulling force is applied to the fastener tape after the fastener element row is sewed to the fastener tape, the fastener tape can be prevented from being torn at a portion in which a sewing yarn has been thrust.

According to the present invention, the weft in-laid yarn is inserted across wales which are fewer by one than the number of the wales over which the tricot type two-stitch knitting yarn runs. As a consequence, for example, if the lateral pulling force is applied when the slide fastener is in an engaged state, the interval between respective elements is narrowed. Thus, even if the lateral pulling force is applied to the fastener tape, the engagement strength of right and left fastener element rows can be intensified to prevent the engagement of the fastener elements from being released.

In the fastener tape, the warp in-laid yarn can be inserted further into the element attaching portion, so that the element attaching portion can be blocked from being stretched in the longitudinal direction and the strength of the element attaching portion can be improved.

Then, the fastener stringer provided by the present invention is produced by attaching the fastener element row to the element attaching portion of the fastener tape having the above-described structure. For this reason, the fastener stringer of the present invention suppresses stretching of the element attaching portion in the longitudinal direction effectively while maintaining plasticity which the knitted fabric inherently possesses. The element attaching portion has a more excellent strength than conventionally, so that the yarns are unlikely to be loose and the fastener tape can be applied to a slide fastener or the like having a larger chain width than a conventional one. Consequently, an application of the fastener stringer can be expanded.

DESCRIPTION OF THE PREFERRED EMBODIMENTS

Hereinafter, preferred embodiments of the present invention will be described in detail with reference to the accompanying drawings. In the meantime, the present invention is not restricted to the embodiments described later and may be modified in various ways as long as a substantially same composition as the present invention is possessed and a same operating effect is exerted.

For example, in each embodiment described below, a warp knitting structure of a fastener tape will be described in detail.

According to the present invention, however, it suffices that an element attaching portion is formed by disposing at least: a warp knitting yarn which runs in a zigzag fashion forming a needle loop across two or more wales such that the needle loop is entangled with a needle loop of another knitting yarn of every other course on a wale; and a weft in-laid yarn runs across two or more wales adjacent to each other. Accordingly, the fastener tape may be knitted using a knitting yarn other than the knitting yarns indicated in the embodiments described below.

First Embodiment

Figure 1:
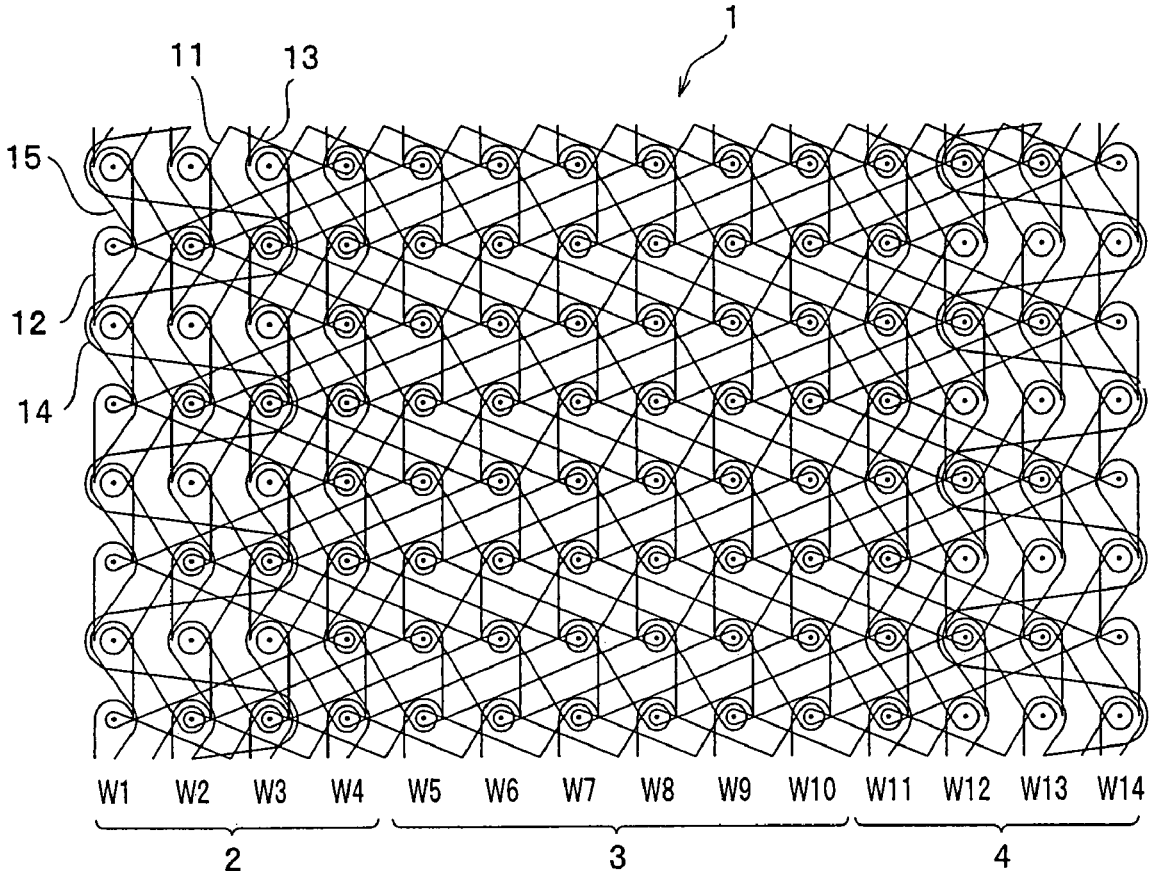
FIG. 1 is a knitting structure diagram showing an entire warp knitting structure of a fastener tape according to a first embodiment.
Figure 2:
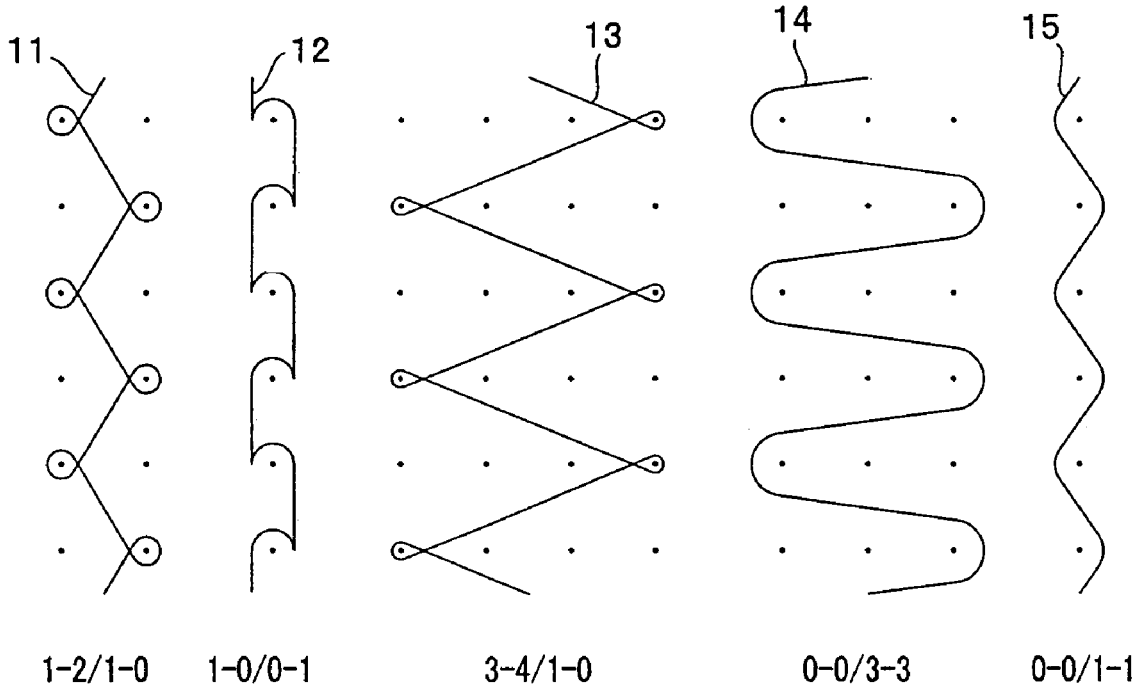
FIG. 2 is a knitting structure diagram of each composition knitting yarn for use in the fastener tape.
Figure 3:
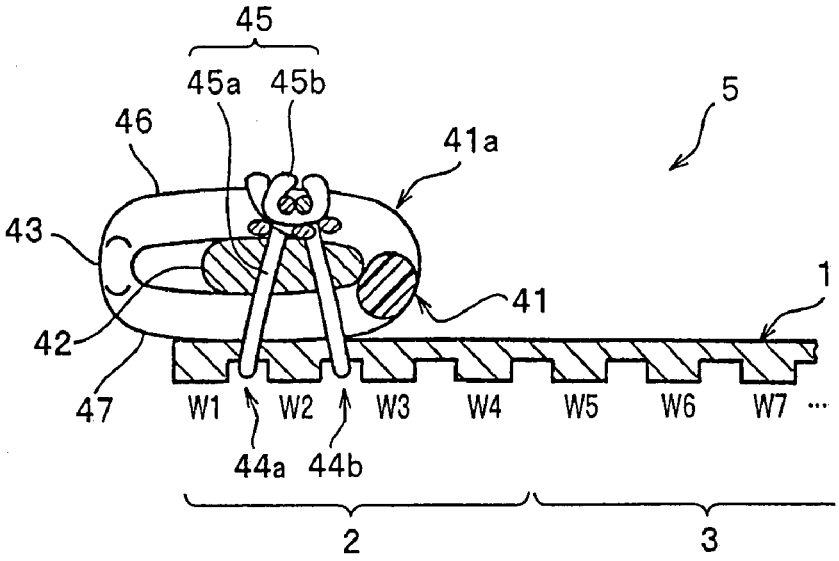
FIG. 3 is a sectional view schematically showing a section of a fastener stringer configured such that a continuous fastener element row is attached to the fastener tape.

FIGS. 1 to 3 show a fastener tape for slide fastener according to a first embodiment of the present invention. FIG. 1 is a knitting structure diagram showing an entire warp knitting structure of the fastener tape, FIG. 2 is a knitting structure diagram of each composition knitting yarn for use in the fastener tape, and FIG. 3 is a sectional view schematically showing a section of a fastener stringer configured such that a continuous fastener element row is attached to the fastener tape.

The fastener tape 1 of the first embodiment is a tape composed of a warp knitting structure which can be knitted with a crochet knitting machine capable of knitting a narrow width tape by driving three warp yarn guide bars independently within a predetermined space without any interference among one another. The fastener tape 1 of the first embodiment is constituted of first wale W1 to fourteenth wale W14 as shown in FIG. 1, and fifth wale W5 to tenth wale W10 form a tape main body portion 3. Further, an element attaching portion 2 is formed of the first wale W1 to fourth wale W4 along one side edge of the tape main body portion 3, and an ear portion 4 is formed of eleventh wale W11 to fourteenth wale W14 along the other side edge of the tape main body portion 3.

The tape main body portion 3 is knitted with a tricot knitting yarn 11 having a closed loop of 1-2/1-0, a chain knitting yarn 12 having a open loop of 1-0/0-1, and a single cord knitting yarn 13 having a closed loop of 3-4/1-0 with its sinker loop running across four wales, as shown in FIG. 2. Each stitch of the warp knitting structure of the tape main body portion 3 is formed by entangling the needle loops of the aforementioned three knitting yarns 11, 12 and 13.

Figure 4:
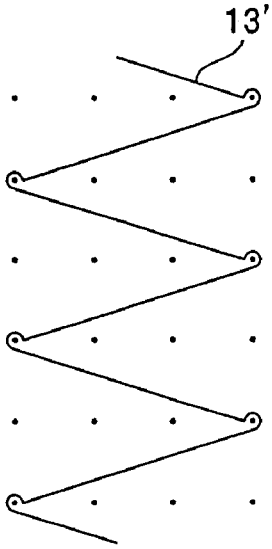
FIG. 4 is a knitting structure diagram of a single cord knitting yarn which may be used in the first embodiment.

In the meantime, in this embodiment, the single cord knitting yarn 13 is knitted with the closed loops as described above. However, the present invention is not restricted to this example, but it may be composed of, for example, a single cord knitting yarn 13' having an open loop of 4-3/0-1, as shown in FIG. 4. Also for the tricot knitting yarn 11 and the chain knitting yarn 12 which constitute the tape main body portion 3, the closed loop or the open loop may be selected arbitrarily.

The element attaching portion 2 is knitted and constituted with a weft in-laid yarn 14 of 0-0/3-3 to be inserted in a zigzag fashion across the first wale W1 to third wale W3 into the knitting structure of the tape main body portion 3, and a warp in-laid yarn 15 of 0-0/1-1 to be inserted in a zigzag fashion in a warp direction of each wale of the first wale W1 to fourth wale W4.

In the first embodiment, the weft in-laid yarn 14 is disposed in the element attaching portion 2, and as the warp knitting yarn which runs in the zigzag fashion forming a needle loop across two or more wales such that the needle loop is entangled with a needle loop of another knitting yarn of every other course on a wale, the tricot knitting yarn 11 and the single cord knitting yarn 13 are disposed.

In the element attaching portion 2, the weft in-laid yarn 14 is inserted so as to cross a sinker loop of the single cord knitting yarn 13 constituting a foundation structure between respective courses. Further, the single cord knitting yarn 13 and the weft in-laid yarn 14 are disposed in the first wale W1 alternately. Consequently, the weft in-laid yarn 14 is disposed in a portion of the element attaching portion 2 in which no single cord knitting yarn 13 is disposed, thereby preventing a drop of partial yarn density and improving the strength of the element attaching portion 2. In the meantime, the weft in-laid yarn 14 is inserted so as to be hidden by the tricot knitting yarn 11 and the single cord knitting yarn 13, so that a satin pattern formed of the tricot knitting yarn 11 and the single cord knitting yarn 13 can be expressed on the fastener tape 1.

Particularly, in the element attaching portion 2, the warp in-laid yarn 15 is inserted into each wale, and each stitch on the fourth wale W4 adjacent the tape main body portion 3 is formed by entangling three needle loops of the tricot knitting yarn 11, the chain knitting yarn 12 and the single cord knitting yarn 13. Consequently, the strength of the element attaching portion 2 is intensified more.

The ear portion 4 is constituted of the same knitting structure as that of the element attaching portion 2. That is, the ear portion is knitted and constituted with the weft in-laid yarn 14 to be inserted across the three wales of the twelfth wale W12 to fourteenth wale W14 into the knitting structure of the tape main body portion 3 and the warp in-laid yarn 15 to be inserted in the warp direction of each wale of the eleventh wale W11 to fourteenth wale W14. The single cord knitting yarn 13 and the weft in-laid yarn 14 cross each other between respective courses of the ear portion 4 and are disposed alternately on the fourteenth wale W14 on the outermost edge.

By constituting the element attaching portion 2 and the ear portion 4 of the fastener tape 1 with the same knitting structure, the knitting structure on the right and left edge portions of the fastener tape 1 is balanced, thereby preventing the fastener tape from being twisted or curved to stabilize the configuration of the fastener tape. As required, the element row may be attached to the ear portion 4 instead of the element attaching portion 2, thereby improving convenience of the fastener tape 1.

In the present invention, material, size, etc. of the knitting yarns 11, 12 and 13 and the in-laid yarns 14, 15 for use in the fastener tape 1 are not restricted to any particular ones, but a multi-filament yarn, textured yarn and the like conventionally used in general may be used and they may be selected arbitrarily depending on application and the like.

In the fastener tape 1 of the first embodiment, stretching of the element attaching portion 2 in the longitudinal direction is suppressed and the strength of the element attaching portion 2 is improved as compared with a narrow width fastener tape having a single structure as described in the aforementioned Japanese Patent Application Laid-Open No. 55-10918 and Japanese Patent No. 3439574. Thus, the fastener tape of the invention can be applied to a slide fastener or the like having a chain width of 7 mm or more, to which a conventional fastener tape cannot be applied due to shortage of the strength, and consequently, its application field can be expanded largely.

The fastener tape 1 hardly loses plasticity inherently possessed by the knitted fabric although its strength is improved and looseness of the yarn becomes unlikely to occur. Consequently, the fastener tape 1 has a feature and superiority which the conventional fastener tape cannot obtain. Further, by using an inexpensive low count yarn (coarse count yarn) for the knitting yarn which constitutes the fastener tape 1, the strength of the fastener tape 1 can be improved further and reduction of cost of the fastener tape can be achieved.

By attaching a continuous fastener element row 41 formed of mono-filament to the fastener tape 1 of the first embodiment, a fastener stringer 5 as shown in FIG. 3 is produced. In this case, first, a core string 42 is inserted into a hollow portion of the element row 41 formed in a coil-like shape, and the element row 41 is placed at a predetermined position of the element attaching portion 2 of the fastener tape 1 with its coupling head 43 directed outward of the fastener tape 1. Next, sewing needles are pierced into a groove portion 44*a* between the first wale W1 and the second wale W2 and a groove portion 44*b* between the second wale W2 and the third wale W3. Thereby, an upper leg portion 46 and a lower leg portion 47 of each element 41*a* are tightened by two needle yarns 45*a* and looper yarn 45*b* as sewing yarns 45 to sew the element row 41 and the core string 42 to the fastener tape 1. At this time, the needle yarn 45*a* is disposed in the respective groove portions 44*a*, 44*b* of the element attaching portion 2.

In the fastener stringer 5 produced in the above-described manner, the single cord knitting yarn 13 and the weft in-laid yarn 14 are disposed on the element attaching portion 2 of the fastener tape 1 as described above, thereby preventing a partial drop of the yarn density and intensifying the strength of the element mounting portion 2. Accordingly, even if a strong lateral pulling force is applied to the fastener stringer 5, the fastener tape 1 can be prevented from being torn at a portion in which the needle yarn 45*a* has been pierced. Further, because in the first wale W1 to third wale W3 of the element attaching portion 2 in which the weft in-laid yarn 14 and the warp in-laid yarn 15 have been inserted, the fastener tape is blocked from being stretched in the tape longitudinal direction and width direction, so that an attachment state of the element row 41 is stabilized. Thus, the fastener stringer 5 can be used in a stable manner in a long period.

In the fastener tape 1 of the first embodiment, the weft in-laid yarn 14 to be disposed on the element attaching portion 2 is inserted across three wales which are fewer by one than the number of the wales over which the single cord knitting yarn 13 runs. Thus, when the lateral pulling force is applied to the fastener stringer 5, the single cord knitting yarn 13 and the weft in-laid yarn 14 are never captured by each other. For this reason, the element attaching portion 2 (first wale W1 to fourth wale W4) of the fastener stringer 5 is slightly stretched in the tape width direction and contracted in the longitudinal direction. Consequently, the interval between the fastener elements of the continuous element row 41 is shortened.

As a result, even if the lateral pulling force is applied to the right and left fastener tapes 1 when the elements are engaged to engage right and left opposing fastener element rows 41 by driving a slider along the pair of right and left fastener stringers 5, an element interval is shortened to intensify the engagement strength, thereby preventing a release of the engagement.

Figure 5:
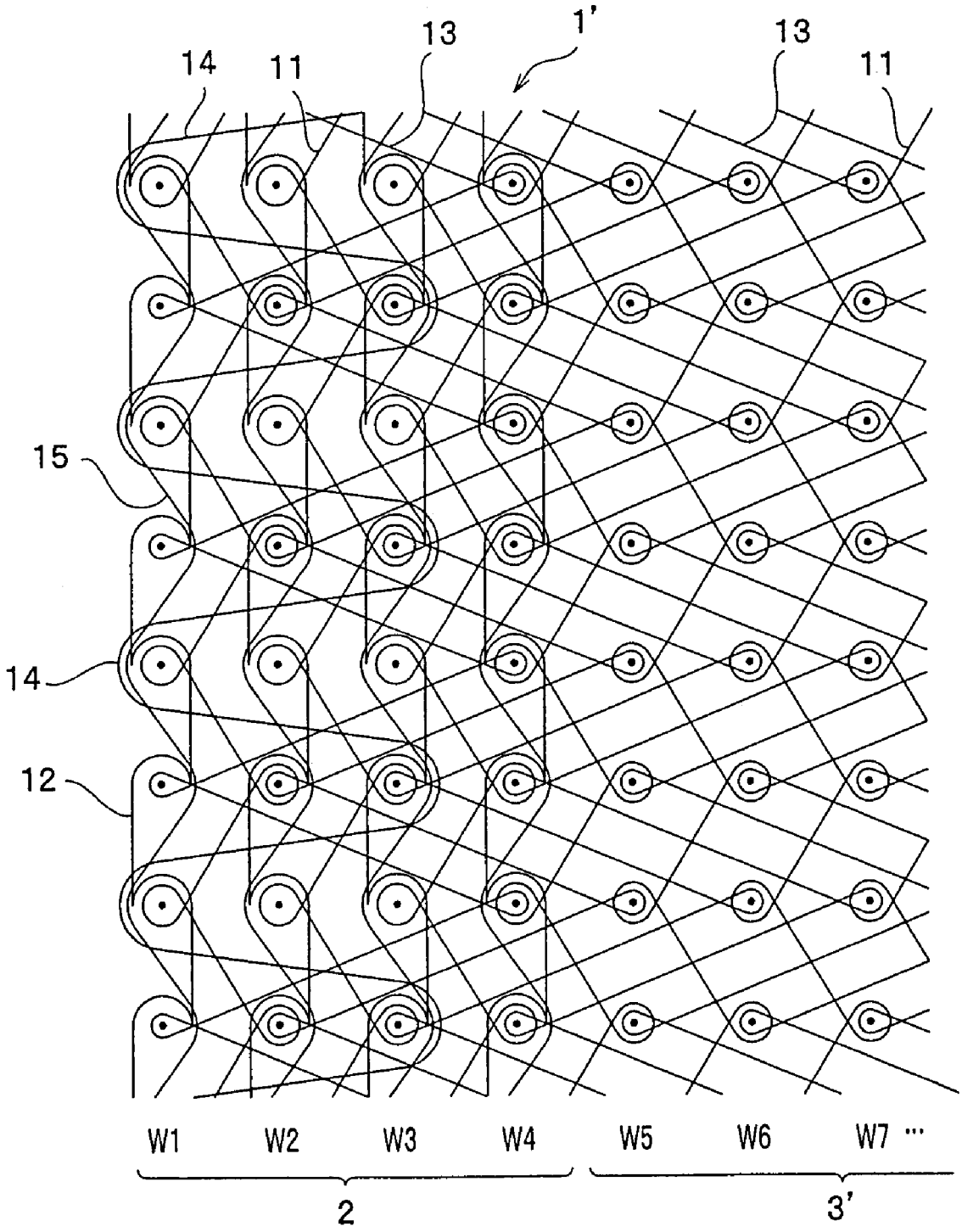
FIG. 5 is a knitting structure diagram partially showing a warp knitting structure of a fastener tape according to a modification of the first embodiment.

FIG. 5 shows a fastener tape 1' according to a modification of the first embodiment. Although in the fastener tape 1' shown in FIG. 5, the configuration (knitting structure) of the element attaching portion 2 is the same as the fastener tape 1 of the first embodiment, the configuration (knitting structure) of a tape main body portion 3' is different from that of the fastener tape 1 of the first embodiment.

More specifically, the tape main body portion 3' of the fastener tape 1' shown in FIG. 5 is constituted of the tricot knitting yarn 11 having a closed loop of 1-2/1-0 and the single cord knitting yarn 13 having a closed loop of 3-4/1-0 with its sinker loop running across four wales, while the chain knitting yarn 12 having an open loop of 1-0/0-1 is omitted.

In such a fastener tape 1' also, the element attaching portion 2 is blocked from being stretched in the longitudinal direction and the strength of the element attaching portion 2 is improved as compared with an conventional example. Consequently, the same effect as that described in the fastener tape 1 of the first embodiment can be obtained. Because this fastener tape 1' includes no chain knitting yarn 12 at the tape main body portion, stretching property of the tape main body portion is improved although the strength of the tape main body portion is inferior to the fastener tape 1 of the first embodiment. Accordingly, when the slide fastener is attached to an attachment object such as clothes, it can be attached thereto with a good appearance and it can meet a stretching action or curving action of the attachment object easily.

Second Embodiment

Figure 6:
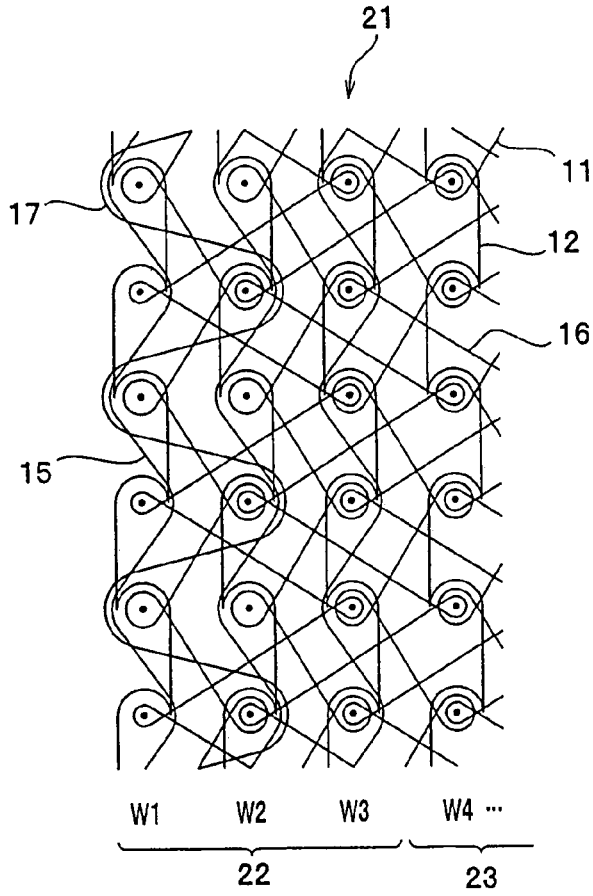
FIG. 6 is a knitting structure diagram partially showing a warp knitting structure of a fastener tape according to a second embodiment.
Figure 7:
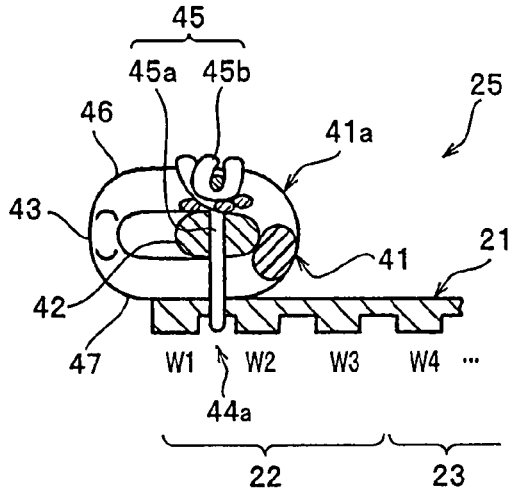
FIG. 7 is a sectional view schematically showing a section of a fastener stringer configured such that a continuous fastener element row is attached to the fastener tape.

Next, a fastener tape according to a second embodiment of the present invention will be described. FIG. 6 is a knitting structure diagram partially showing a warp knitting structure of the fastener tape according to the second embodiment of the invention, and FIG. 7 is a sectional view schematically showing the section of a fastener stringer configured such that a continuous fastener element row is attached to the fastener tape. In the meantime, in the second embodiment and third and fourth embodiments described later, the same reference numerals are used for knitting yarns and members having the same configuration as the first embodiment and description thereof is omitted, while mainly a configuration different from the first embodiment will be described.

In a fastener tape 21 of the second embodiment shown in FIG. 6, an element attaching portion 22 constituted of first wale W1 to third wale W3 is formed along one side edge of a tape main body portion 23 having a warp knitting structure. An ear portion (not shown) is formed on the other side edge of the tape main body portion 23.

In the fastener tape 21 of the second embodiment, the tape main body portion 23 is knitted and constituted of a tricot knitting yarn 11 and a chain knitting yarn 12 which form the same knitting structure as the first embodiment and a single cord knitting yarn 16 having a closed loop of 2-3/1-0 running across three wales. Needle loops of the above-described three knitting yarns 11, 12 and 16 are entangled in each stitch. For the tricot knitting yarn 11, the chain knitting yarn 12 and the single cord knitting yarn 16, the closed loop or open loop can be selected arbitrarily like the first embodiment.

The element attaching portion 22 is constituted of three wales W1 to W3 which are fewer by one than the first embodiment. The element attaching portion 22 is constituted with a weft in-laid yarn 17 of 0-0/2-2 running in a zigzag fashion across the first wale W1 and the second wale W2 in the knitting structure of the tape main body portion 23 of the second embodiment and a warp in-laid yarn 15 of 0-0/1-1 running in the zigzag fashion in the warp direction of each wale of the first wale W1 to third wale W3.

That is, also in the second embodiment, the weft in-laid yarn 17 is disposed in the element attaching portion 22, and as the warp knitting yarn which runs in the zigzag fashion forming a needle loop such that the needle loop is entangled with a needle loop of another knitting yarn of every other course on a wale, the tricot knitting yarn 11 and the single knitting yarn 16 are disposed.

In the element attaching portion 22, the weft in-laid yarn 17 is inserted so as to cross the single cord knitting yarn 16 between respective courses, and the single cord knitting yarn 16 and the weft in-laid yarn 17 are knitted and disposed alternately in the first wale W1. Consequently, a partial drop of the yarn density is prevented, thereby improving the strength of the element attaching portion 22. In the meantime, the ear portion (not shown) of the second embodiment is formed of the same knitting structure as the element attaching portion 22 along the side edge of the tape main body portion 23 on an opposite side to the element mounting portion 22 such that it runs across three wales. Consequently, the right and left balance of the fastener tape 21 is secured and convenience thereof is improved.

The fastener tape 21 of the second embodiment possesses the plasticity inherent to the fabric, and the element attaching portion 22 thereof is blocked from being stretched in the longitudinal direction. Further, the strength of the element attaching portion 22 is improved as compared with the narrow width fastener tape having the conventional single structure. Therefore, like the first embodiment, the yarns are unlikely to be loose and the fastener tape can be applied to a slide fastener or the like having a chain width of 7 mm or more.

By attaching a continuous fastener element row 41 to the fastener tape 21 of the second embodiment, a fastener stringer 25 as shown in FIG. 7 is produced. Basically, the fastener element row 41 can be attached in the same manner as in the first embodiment. However, the element row 41 and the core string 42 are sewed to the fastener tape 21 with a needle yarn 45*a* and a looper yarn 45*b* disposed in the groove portion 44*a* by piercing a sewing needle into only the groove portion 44*a* between the first wale W1 and the second wale W2, because the element attaching portion 22 of the fastener tape 21 of the second embodiment is constituted of the three wales W1 to W3 as described above.

The fastener stringer 25 produced in this way can provide the same effect as the fastener stringer 5 of the first embodiment. That is, because the strength of the element attaching portion 22 is high, the fastener tape can be prevented from being torn at the portion in which the needle yarn 45*a* has been thrust even if a strong lateral pulling force is applied. Further, even if the lateral pulling force is applied to the right and left fastener tapes 21 when the elements are engaged, the engagement strength is intensified so as to prevent the engagement from being released because the element attaching portion 22 is contracted in the longitudinal direction so that each element interval of the element row 41 is shortened.

Third Embodiment

Figure 8:
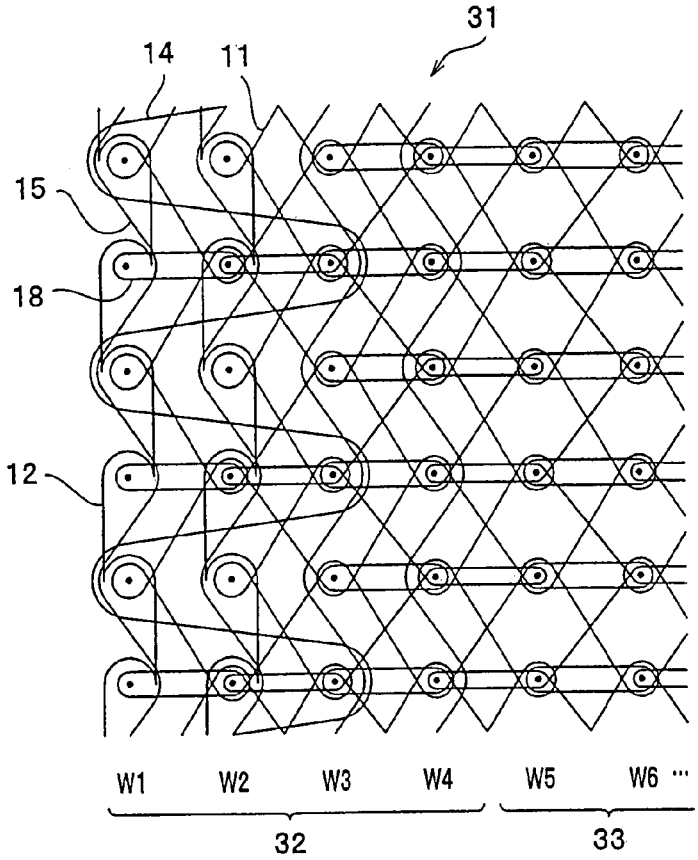
FIG. 8 is a knitting structure diagram partially showing a warp knitting structure of a fastener tape according to a third embodiment.
Figure 9:
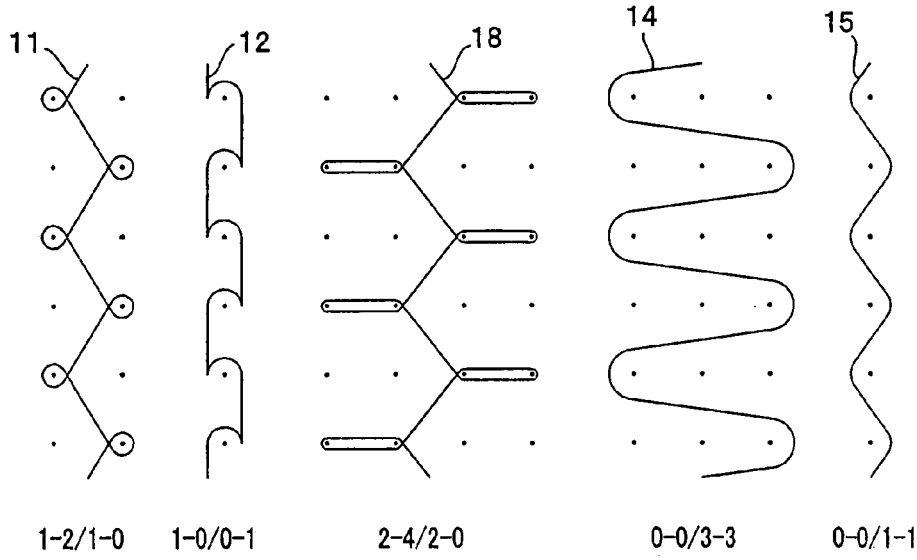
FIG. 9 is a knitting structure diagram of each composition yarn for use in the fastener tape.

FIGS. 8 and 9 show a fastener tape according to a third embodiment of the present invention. FIG. 8 is a knitting structure diagram partially showing a warp knitting structure of the fastener tape of the third embodiment, and FIG. 9 is a knitting structure diagram of each composition yarn for use in the fastener tape.

In the fastener tape 31 of the third embodiment, an element attaching portion 32 composed of first wale W1 to fourth wale W4 is formed along one side edge of a tape main body portion 33. An ear portion (not shown) is formed on the other side edge of the tape main body portion 33.

The tape main body portion 33 is constituted of a tricot knitting yarn 11 having a closed loop of 1-2/1-0 and a tricot type two needle stitch yarn 18 which forms a stitch across four wales as shown in FIG. 9 so as to construct the warp knitting structure.

The element attaching portion 32 is constituted with a chain knitting yarn 12 having an open loop of 1-0/0-1 disposed in the first wale W1 and second wale W2 in the knitting structure of the tape main body portion 33, a weft in-laid yarn 14 to be inserted in a zigzag fashion across the first wale W1 to third wale W3, and a warp in-laid yarn 15 to be inserted in a zigzag fashion in the warp direction of each wale of the first wale W1 to fourth wale W4.

That is, in the third embodiment, the weft in-laid yarn 14 is disposed in the element attaching portion 32, and as the warp knitting yarn which runs in the zigzag fashion forming a needle loop across two or more wales such that the needle loop is entangled with a needle loop of another knitting yarn of every other course on a wale, the tricot type two needle stitch knitting yarn 18 is disposed.

In the third embodiment, a configuration of a tape side edge portion is stabilized by disposing the chain knitting yarn 12 on the first wale W1 and the second wale W2. Further, by omitting the chain knitting yarn 12 disposed on the third and fourth wales W3 and W4 in the first embodiment, thickness of the fastener tape is prevented from being partially increased in the wales W3 and W4.

In the element attaching portion 32, the weft in-laid yarn 14 is inserted so as to be entangled with a sinker loop of the tricot type two needle stitch knitting yarn 18 between respective courses, and further, the tricot type two needle stitch knitting yarn 18 and the weft in-laid yarn 14 are knitted so as to be disposed alternately in the first wale W1. Consequently, the weft in-laid yarn 14 is disposed at a portion of the element attaching portion 32 in which no tricot type two needle stitch knitting yarn 18 is disposed, thereby preventing the yarn density from dropping partially to improve the strength of the element attaching portion 32.

In the third embodiment, the ear portion is constituted of the same knitting structure as that of the element mounting portion 32 in four wales on the other side edge of the tape main body portion 33, so that the right and left balance of the fastener tape 31 is secured and convenience of the tape is improved.

The fastener tape 31 of the third embodiment possesses the plasticity inherent to the knitted fabric. At the same time, the element attaching portion 32 is blocked from being stretched in the longitudinal direction, and the strength of the element attaching portion 32 is improved as compared with the narrow width fastener tape having the conventional single structure. Thus, like the first embodiment, the yarns are unlikely to be loose and the fastener tape can be used in a slide fastener or the like having a chain width of 7 mm or more, so that its application field can be expanded.

Further, by attaching a continuous fastener element row 41 to the fastener tape 31 of the third embodiment in the same manner as in the first embodiment, a fastener stringer is produced. In the fastener stringer produced from the fastener tape 31, the strength of the element attaching portion 32 is intensified by the tricot type two needle stitch knitting yarn 18 and the weft in-laid yarn 14, thereby preventing the fastener tape from being torn at the portion in which the needle yarn has been thrust.

In the fastener tape 31 of the third embodiment, the weft in-laid yarn 14 disposed in the element attaching portion 32 is disposed across three wales which are fewer by one than the number of the wales in which the tricot type two needle stitch knitting yarn 18 is disposed. Thus, even if the lateral pulling force is applied to the right and left fastener tapes 31 when the elements are engaged, the element attaching portion 32 of the fastener tape 31 is contracted in the longitudinal direction so that each element interval is shortened. Consequently, the engaging strength is intensified, thereby preventing the engagement from being released.

Fourth Embodiment

Figure 10:
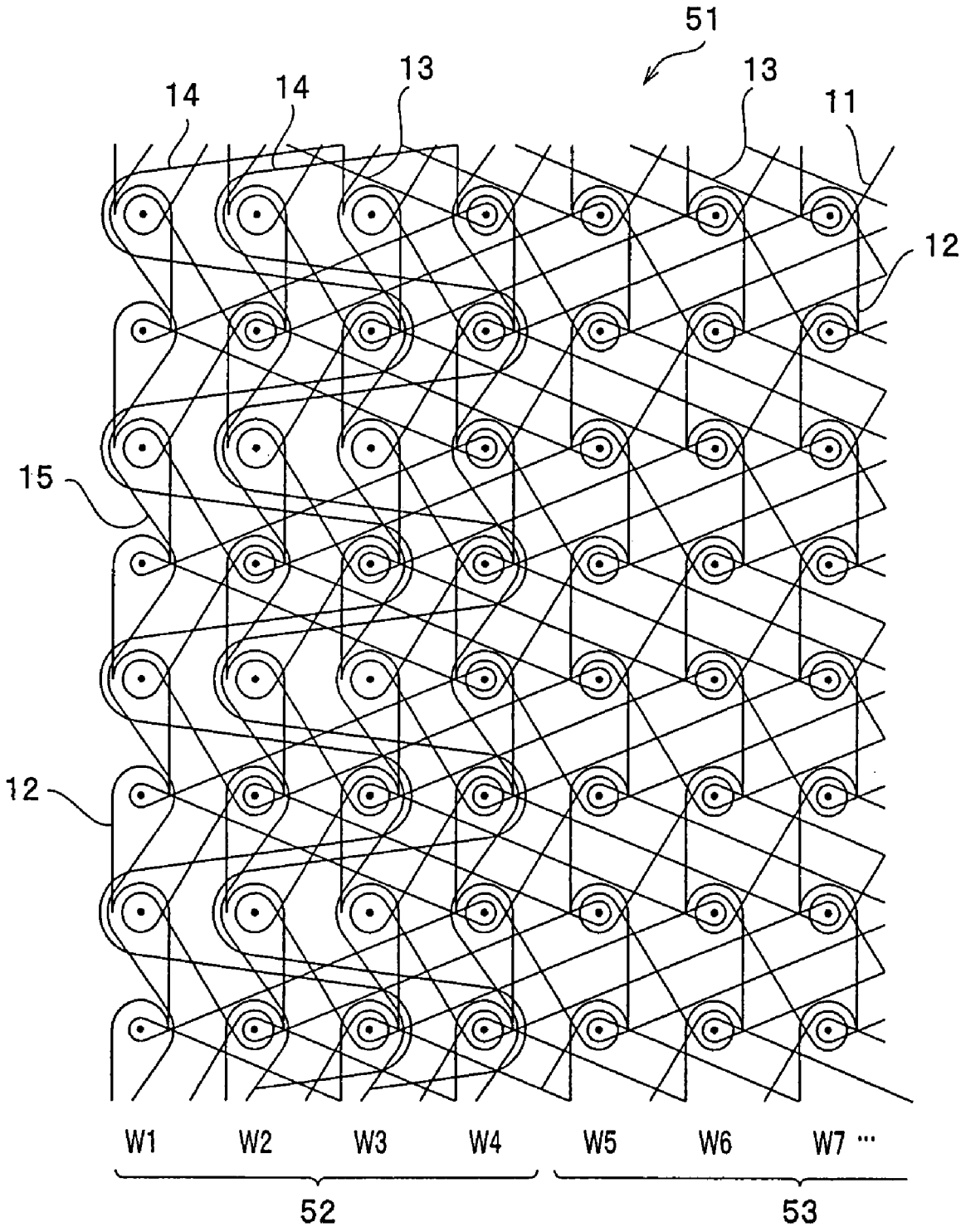
FIG. 10 is a knitting structure diagram partially showing a warp knitting structure of a fastener tape according to a fourth embodiment.

FIG. 10 is a knitting structure diagram partially showing a warp knitting structure of a fastener tape 51 according to a fourth embodiment of the present invention.

In the fastener tape 51 of the fourth embodiment, an element attaching portion 52 composed of first wale W1 to fourth wale W4 is formed along one side edge of a tape main body portion 53, and an ear portion (not shown) is formed on the other side edge of the tape main body portion 53.

The tape main body portion 53 has the same knitting structure as that in the first embodiment. That is, the tape main body portion 53 is constituted of a tricot knitting yarn 11 having a closed loop of 1-2/1-0, a chain knitting yarn 12 having an open loop of 1-0/0-1, and a single cord knitting yarn 13 having a closed loop of 3-4/1-0 with its sinker loop running across four wales.

The element attaching portion 52 is constructed by knitting two weft in-laid yarns 14 of 0-0/3-3 to be inserted in the zigzag fashion across the first wale W1 to the third wale W3 and the second wale W2 to the fourth wale W4; and a warp in-laid yarn 15 of 0-0/1-1 inserted in the zigzag fashion in the warp direction of each wale of the first wale W1 to the fourth wale W4 in the knitting structure of the above-mentioned tape main body portion 53.

That is, in the fourth embodiment, the two weft in-laid yarns 14 are disposed in the element attaching portion 52, and as the warp knitting yarn which runs in the zigzag fashion forming a needle loop over two or more wales such that the needle loop is entangled with a needle loop of another knitting yarn of every other course on a wale, the tricot knitting yarn 11 and the single cord knitting yarn 13 are disposed.

In the element attaching portion 52, the two weft in-laid yarns 14 are inserted such that they cross a single cord knitting yarn 16 between respective courses, and further, the single cord knitting yarn 16 and the weft in-laid yarn 14 running across the first wale W1 to the third wale W3 are disposed alternately in the first wale W1. Consequently, a partial drop of the yarn density is prevented, thereby improving the strength of the element attaching portion 52.

The fastener tape 51 of the fourth embodiment possesses the plasticity inherent to the knitted fabric, and stretching of the element attaching portion 52 in the longitudinal direction is suppressed. Further, because the two weft in-laid yarns 14 are inserted in the element attaching portion 52, the strength of the element attaching portion 52 is improved as compared with the fastener tape 1 of the first embodiment.

By attaching a continuous fastener element row 41 to the fastener tape 51 of the fourth embodiment in the same manner as in the first embodiment, a fastener stringer is produced. Because the strength of the element attaching portion 52 is very high, the fastener stringer produced from the fastener tape 51 can effectively prevent the element attaching portion 52 from being torn even if a strong lateral pulling force is applied to the fastener stringer. In addition, because the weft in-laid yarn 14 and the warp in-laid yarn 15 are inserted across the first wale W1 to the fourth wale W4 of the element mounting portion 52, stretching of the fastener tape in the longitudinal direction and width direction is suppressed, so that the attachment state of the element row 41 is stabilized. Therefore, the fastener stringer 5 can be used in a stabilized manner in a long period.

The present invention is applied to a fastener tape for slide fastener used as a fastener stringer of a slide fastener by sewing a continuous fastener element row thereto, and also to the fastener stringer effectively.

What is claimed is:

1. A fastener tape which is used for a slide fastener, formed in a narrow width, and composed of warp knitting structures in which an element attaching portion constituted of a plurality of wales is integrally formed by knitting along one side edge of a tape main body portion, wherein the element attaching portion is formed by disposing at least:

warp knitting yarns which have two different kinds of warp knitting structures and run in a zigzag fashion forming a needle loop across two or more wales adjacent to each other such that the needle loop is entangled with a needle loop of another knitting yarn of every other course on a wale; and a weft in-laid yarn which runs across two or more wales adjacent to each other.

2. The fastener tape according to claim 1, wherein the element attaching portion is constituted of a knitting structure formed of a tricot knitting yarn, a chain knitting yarn and a single cord knitting yarn.

3. The fastener tape according to claim 2, wherein a sinker loop of the single cord knitting yarn and the weft in-laid yarn cross each other between respective courses of the element attaching portion, and the single cord knitting yarn and the weft in-laid yarn are disposed alternately in a first wale formed on an outermost side of the element attaching portion.

4. The fastener tape according to claim 3, wherein the weft in-laid yarn is inserted across wales which are fewer at least by one than a number of wales over which the single cord knitting yarn runs.

5. The fastener tape according to any one of claims 2 to 4, wherein a warp in-laid yarn is inserted into the element attaching portion.

6. The fastener tape according to claim 1, wherein the element attaching portion is constituted of a knitting structure formed of a tricot knitting yarn, a tricot type two needle stitch knitting yarn, and a chain knitting yarn disposed in part of wales.

7. The fastener tape according to claim 6, wherein a sinker loop of the tricot type two needle stitch knitting yarn and a weft in-laid yarn cross each other between respective courses of the element attaching portion, and the tricot type two needle stitch knitting yarn and the weft in-laid yarn are disposed alternately in a first wale formed on an outermost side of the element attaching portion.

8. The fastener tape according to claim 7, wherein the weft in-laid yarn is inserted across wales which are fewer at least by one than a number of wales over which the tricot type two needle stitch knitting yarn runs.

9. The fastener tape according to any one of claims 6 to 8, wherein a warp in-laid yarn is further inserted into the element attaching portion.

10. A fastener stringer, wherein a fastener element row is attached to the element attaching portion of the fastener tape according to claim 1.

11. The fastener tape according to claim 1, wherein the warp knitting yarn and the weft in-laid yarn are disposed alternately in a first wale formed on an outermost side of the element attaching portion.

12. The fastener tape according to claim 11, wherein the weft in-laid yarn is inserted across wales which are fewer at least by one than a number of wales over which the warp knitting yarn runs.

13. The fastener tape according to claim 11, wherein a warp in-laid yarn is inserted into the element attaching portion.

* * * * *